US006553826B1

(12) United States Patent
Harzenmoser

(10) Patent No.: US 6,553,826 B1
(45) Date of Patent: Apr. 29, 2003

(54) PROCESS AND DEVICE FOR MONITORING THE QUALITY OF TEXTILE STRIPS

(75) Inventor: Isidor Harzenmoser, Wallisellen (CH)

(73) Assignee: Zellweger Luwa AG, Uster (CH)

( * ) Notice: Subject to any disclaimer, the term of this patent is extended or adjusted under 35 U.S.C. 154(b) by 0 days.

(21) Appl. No.: 09/914,722

(22) PCT Filed: Feb. 25, 2000

(86) PCT No.: PCT/CH00/00106

§ 371 (c)(1),
(2), (4) Date: Sep. 19, 2001

(87) PCT Pub. No.: WO00/52239

PCT Pub. Date: Sep. 8, 2000

(30) Foreign Application Priority Data

Mar. 4, 1999 (CH) ..... 0397/99

(51) Int. Cl.[7] ..... G01L 5/04
(52) U.S. Cl. ..... 73/160; 73/159
(58) Field of Search ..... 73/160, 159; 364/469

(56) References Cited

U.S. PATENT DOCUMENTS

| | | | | | |
|---|---|---|---|---|---|
| 3,741,054 | A | * | 6/1973 | Alperin et al. | 83/80 |
| 3,831,444 | A | * | 8/1974 | Sasaki et al. | 73/160 |
| 4,037,104 | A | * | 7/1977 | Allport | 250/359 |
| 4,829,194 | A | * | 5/1989 | LeClaire | 250/559 |
| 4,984,749 | A | * | 1/1991 | Matsui et al. | 242/35.5 |
| 5,426,823 | A | | 6/1995 | Feller et al. | |
| 5,563,809 | A | * | 10/1996 | Williams et al. | 364/560 |
| 5,691,908 | A | * | 11/1997 | Adamy | 364/469 |
| 6,174,413 | B1 | * | 1/2002 | Ruf et al. | 162/259 |
| 6,341,525 | B1 | * | 1/2002 | Takada et al. | 73/627 |

FOREIGN PATENT DOCUMENTS

| | | |
|---|---|---|
| EP | 0 606 615 A1 | 7/1994 |
| EP | 0 678 601 A3 | 10/1995 |
| EP | 0 678 601 A2 | 10/1995 |
| EP | 0 799 916 A3 | 10/1997 |
| EP | 0 799 916 A2 | 10/1997 |
| WO | WO 93/18213 | 9/1993 |

* cited by examiner

*Primary Examiner*—Hezron Williams
*Assistant Examiner*—Lilybett Martir
(74) *Attorney, Agent, or Firm*—Burns, Doane, Swecker & Mathis, L.L.P.

(57) ABSTRACT

The invention relates to a process and a device for monitoring the quality of a strip (37, 44, 50) made of textile fibres which is moved in its longitudinal direction. In order to create a device and a process which allow flaws in a strip to be dealt with in a targeted manner and which facilitate the production of a strip which is as free as possible of variations in the cross-section or mass, variations in the mass of the strip are to be continuously detected and converted into an electrical signal. This signal should also be compared with a plurality of predetermined limiting values, limiting values for variations transverse to the longitudinal direction being provided and limiting values for variations in the longitudinal direction of the strip being provided.

9 Claims, 3 Drawing Sheets

PROCESS AND DEVICE FOR MONITORING THE QUALITY OF TEXTILE STRIPS

The invention relates to a process for monitoring the quality of a strip made of textile fibres which is moved in its longitudinal direction.

In this context a strip made of textile fibres is understood to mean a fibre composite made of fibres which can be used to produce textiles. The fibres are loosely joined to one another therein and form an approximately cylindrical body which is compressible. It is known that strips of this type are present at the output of card machines, combers or drawing frames and are stored temporarily in cans. Yarn is preferably produced from strips of this type.

The quality requirements on strips are constantly increasing. Up until now on-line detection of CV% values, spectrograms, thick points and variations in the strip weight over several metres of the strip length etc. was sufficient. Therefore, in the last few decades it has been possible to considerably improve the mean linear uniformity of yarn and drawing frame strips. Consequently, the quality of end products such as woven and knitted fabrics has also improved. In these improved end products rare occurrences such as thin and thick points in the yarn, are all the more disruptive the longer they are. The optical appearance of flat goods produced today usually appears so uniform that rare thin and thick points in the yarn, which owing to the surrounding increased yarn non-uniformity did not lead to complaints up until a few years ago, are classified as disruptive. That which was still regarded as best quality several years ago would now already be considered in the range of second quality, with corresponding losses in yield.

More recent spinning processes require more extensive detection of quality features of the strip in order to be able to finely tune the spinning machine such that yarn production without interruption is achieved.

With known drawing frame levelling, short thick and thin points in the strip may no longer be levelled if they are only a few cm in length as levelling only starts to become effective after approximately 20 cm strip length. It should be noted that even relatively short flaws in the strip, which are still present at the output of the frame, are often lengthened in the subsequent process stages by a factor corresponding to the overall drawing in this process stage. Therefore, flaws in the strip of several centimetres in length produce flaws in the yarn of several metres in length. Thick points in the strip are potentially only partially drawn and removed. Thick points in the form of transferred bundles of fibres, for example, may no longer be drawn. Therefore, with increasing overall draw the relative proportion of such a thick point will also increase and its disruptive effect is made disproportionately noticeable. With thin points in the strip which are lengthened by the overall draw, the thickness of the product also decreases in this region accordingly. Rovings drawn in this way can lead to disruptions during spinning or can leave behind visible traces in the end product, so the end product is downgraded with regard to its quality class. This leads to losses in yield as a result.

A process and a device for monitoring the quality on-line in the spinning mill advance unit is known from EP 0 606 615. Thick points in a strip can be detected thereby, so an alarm is triggered or the plant can be stopped. To this end, the mass of the strip is measured and a signal derived from this measurement compared with a limiting value. This limiting value is determined from the mass non-uniformity (CV%) and a limiting value factor.

A disadvantage of the known device or known process is that thick points of short length are not fully detected and taken into account for an alarm etc. Thick points are also only taken into account independently of their length. It is sufficient to detect a specific variation in the mass, based on a predetermined unit of length, in order to influence, for example, a control process.

Measurement of the strip mass at the output of a frame is known from WO 93/18213. The measured strip mass is used to control the variable draw in the frame. Measurement of the strip mass forms part of a closed control circuit for the frame, in this case.

A particular disadvantage of this device is that the length of a variation in the mass from a mean value is significant for this control in that it is present for a certain period of time and therefore influences the actual draw ratio during this time. However, there is no combined assessment of a variation in which the size of the variation in the mass and the length or duration of this variation are calculated simultaneously with regard to the effective influence in the end product.

An object of the invention is therefore to create a device and a process which allow flaws in a strip to be dealt with in a targeted manner and allow the production of a strip which is as free as possible of variations in the cross-section or mass.

This is achieved in that variations in the mass of the strip are continuously detected at the output of a machine for spinning preparation, such as in particular a card machine, comber or a drawing frame, and are converted into an electrical signal after which this signal is compared with a plurality of predetermined limiting values. Limiting values are provided for variations transverse to the longitudinal direction and limiting values are provided for the extent of the variation in the longitudinal direction of the strip. A length and a cross-sectional variation are determined for each variation from the comparison of the signal with the various limiting values and a quality feature is formed from the length and the cross-sectional variation, identical quality features being counted. This corresponds to a classification of thick and thin points in the strip and the association of the detected variations to a group or to a group of classes is designated as a quality feature. The limiting values for the variation in the longitudinal direction are, for example, at intervals of 1 cm to one another and the limiting values for the variation transverse to the longitudinal direction at intervals of 5% of the mean mass of the strip. A measure for improving the quality of the strip is derived from the quality features, i.e. from the occurrences or variations counted in the various classes. Such a measure is the emission of a warning signal, for example by actuating a warning light, stopping production machines which have caused or have not reduced the variation, or of production machines which are to process the strip with the inadmissible variation and finally, cleaning of the relevant processing machine. The flawed portion of the strip can be removed and analysed from which information can be obtained as to how settings in the relevant production machines are to be altered. It can also be seen from the classification whether a flaw or a variation deserves further observance at all and triggers measures or not. A prediction regarding consequences in the subsequent processes can be made. For example, it can be assumed that, starting from certain classifications, broken threads during spinning can be predicted. Therefore, the performance in subsequent processes can be estimated.

The advantages achieved thereby can, in particular, be seen in that the flaws or variations in the strip can be dealt with in a very differentiated manner. Every user can draw specific conclusions valid for his production plant from the signals or from their classification and take suitable measures. Flaws in the strip are detected early and can be dealt with where they occur according to their nature, or it can be detected early on that they cannot be corrected. Therefore, the corresponding portion of the strip or a part of the raw material can be removed in a production stage which permits this with relatively few or harmless interventions. Therefore it is, for example, easier to remove flaws from the non-woven fabric of a card machine than from a strip.

The invention will be described in more detail hereinafter with the aid of an example and with reference to the attached drawings, in which.

Figure 1:
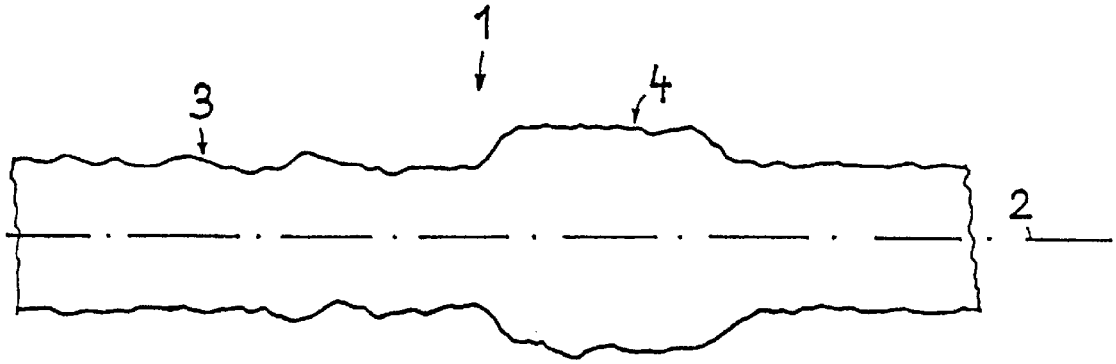
FIG. 1 shows a strip with a variation.

FIG. 1 shows a section of a strip 1 made of textile fibres in a view which extends in the longitudinal direction along an axis 2. A section 3 with an approximately normal or mean diameter and a section 4 with varying, in particular increased diameter, can be seen. It can be assumed that the mass of the strip 1 in section 3 achieves values which fluctuate about a mean value within narrow limits. In section 4, the values of the mass obviously vary, however, they are without doubt increased here. The mass or the cross-section can be detected capacitively in an electrical field or optically in a light beam in a manner known per se and with known apparatuses and can be converted into an electrical signal.

Figure 2:
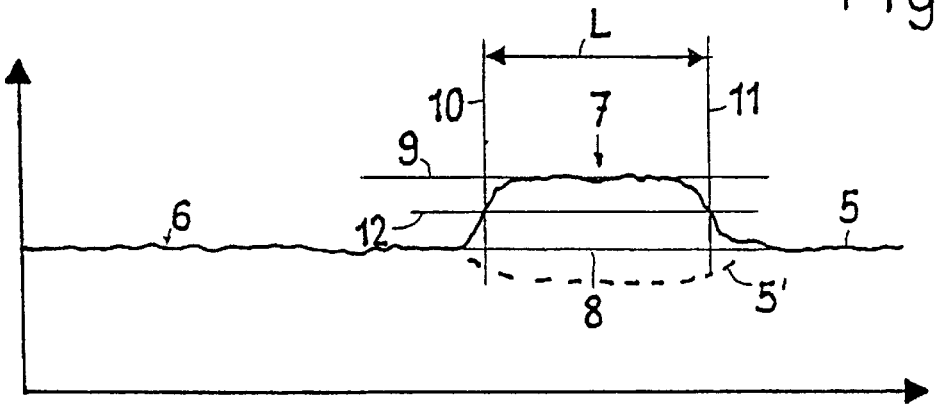
FIG. 2 shows a signal derived from the strip.

FIG. 2 shows, for example, an electrical signal 5 as it could be derived from the strip 1. Thus, a section 6 can also be seen in which the signal 5 fluctuates about a mean value, as is shown by a line 8, and a section 7 with values which vary strongly and persistently from the mean value. The variation in section 7 provides, for example, values which correspond to the line 9. The variation in section 7 has a length L which is counted between lines 10 and 11. So not every variation is detected immediately as such and the length thereof determined, these are only taken into account from a certain threshold which is determined in this case by a value as given by a line 12. This value corresponds, for example, to X% of the mean value. The lines 10 and 11 are located, for example, at the point of intersection of the line 12 with the signal 5. Although a thick point in the strip is shown here, precisely corresponding values at a thin point with a reduced cross-section may be derived and this would produce a signal 5'.

Figure 3:
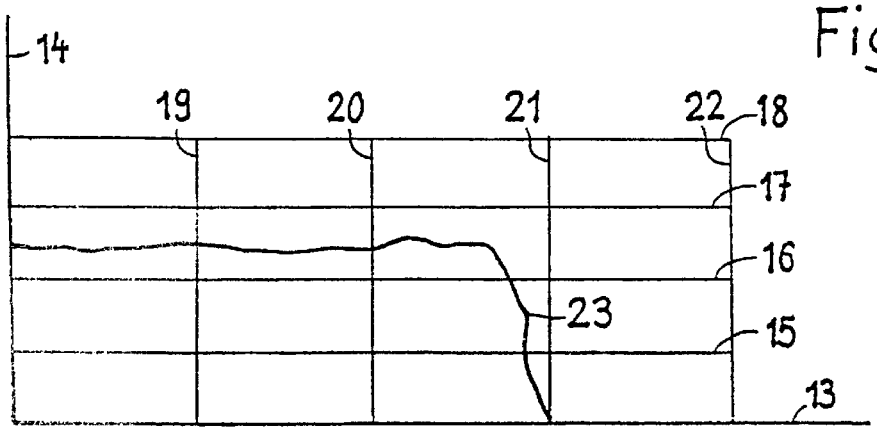
FIG. 3 shows a processing stage of the signal according to FIG. 2.

FIG. 3 shows via axes 13 and 14 a plurality of limiting values for variations in the mass or cross-section of the strip transverse to the longitudinal direction of the strip, which limiting values are given by lines 15, 16, 17 and 18 and limiting values for the length of the deviations in the longitudinal direction which are shown by lines 19, 20, 21, 22. A signal 23 is shown in this field with the various limiting values, which signal 23 corresponds, for example, to the signal 5 in FIG. 2 or is derived by filtering or another treatment. The lines 15 to 22 define a classification field with fields which are limited by four lines respectively and correspond to one class. A class also indicates a quality feature in that a specific class represents a variation with no or harmless consequences and another class represents serious or alarming consequences which this variation can have in the production process of a textile product or in the end product. It can in particular be seen here that the signal transverse to the longitudinal direction of the strip exceeds two limiting values corresponding to lines 15, 16 and also exceeds two limiting values corresponding to lines 19, 20 in the longitudinal direction. Typically, the limiting values for the variation in the longitudinal direction follow one another at intervals of 1 cm and the limiting values for the variation transverse to the longitudinal direction follow one another at intervals of 5% of the mean mass of the strip.

Figure 4:
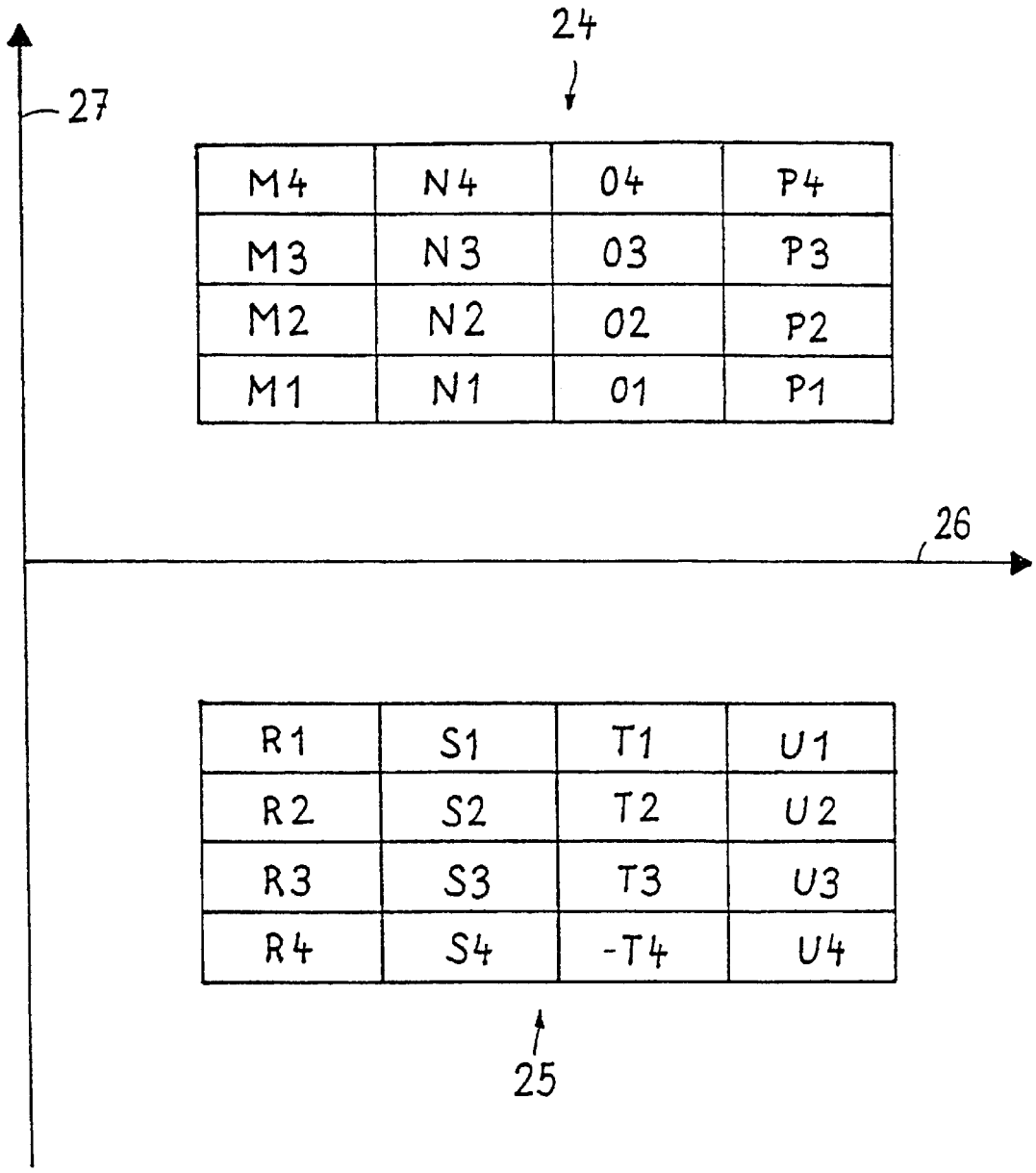
FIG. 4 shows a classification field for variations in the strip.

FIG. 4 shows a classification field 24 with limiting values for thick points and a classification field 25 with limiting values for thin points. Both are set in relation to axes 26, 27 which provide a standard for the size of the variations along and transverse to the longitudinal direction of the strip. Classes of this type can be denoted by a letter/number combination. Logarithmised values of the length are preferably plotted along the axis 26 and values for the percentage increase in cross-sections or the mass of the strip are preferably plotted along the axis 27.

Figure 5:
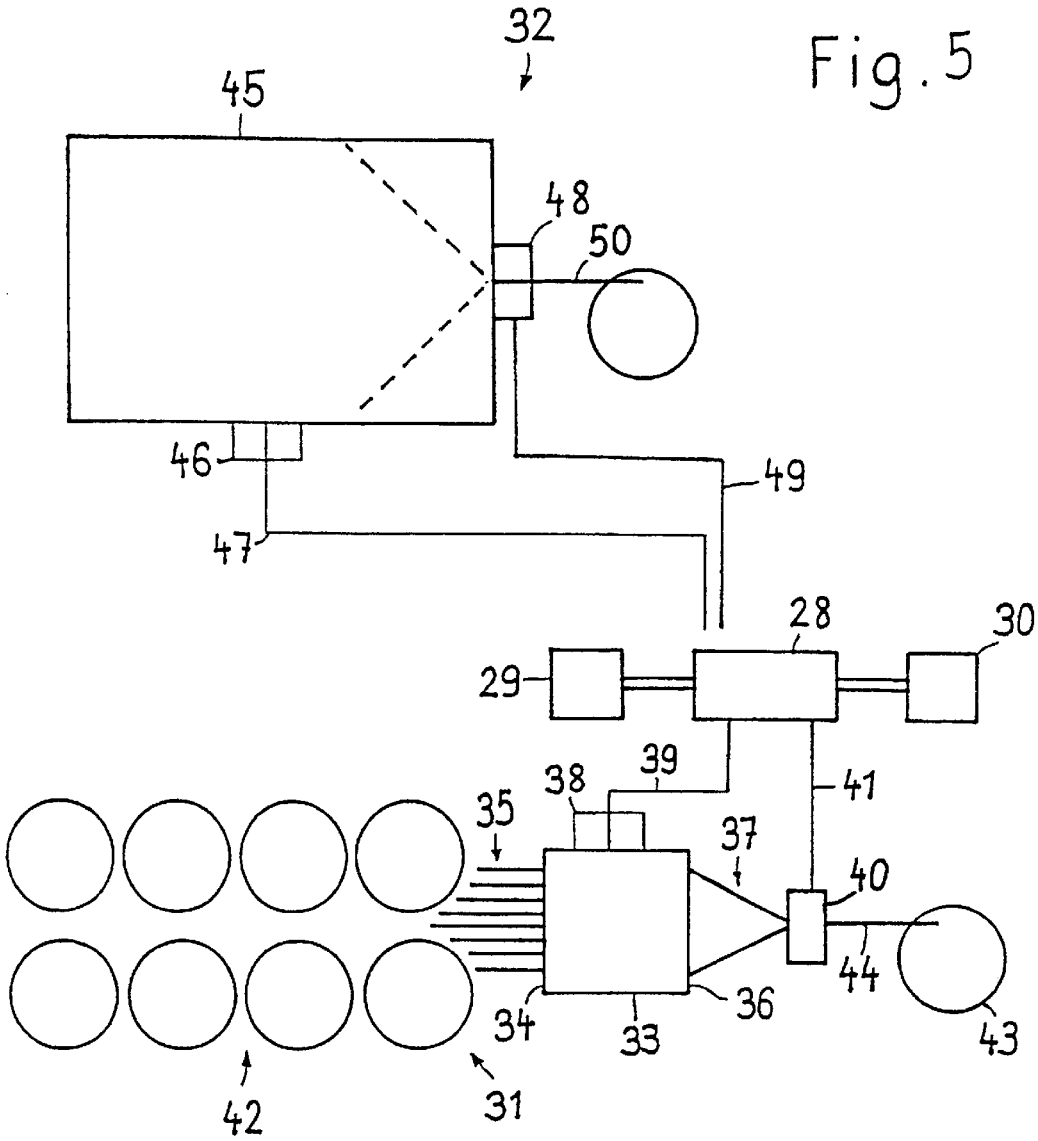
FIG. 5 shows a schematic drawing of a device according to the invention.

FIG. 5 shows a device for monitoring the quality of a strip which comprises a computer 28 which is connected in a manner known per se to an input unit 29 for data, on the one hand, and to an output unit 30 for data, on the other hand. This computer 28 can be connected, on the one hand, to a drawing frame 31 or, on the other hand, to a card machine or a comber 32. In both cases it fulfils the same function, also has an identical construction, and is connected to a machine for spinning preparation like the drawing frame, card machine or comber.

The drawing frame comprises in a known manner the actual drawing frame 33 with an inlet 34 for strips 35 and an outlet 36 for drawn strips 37. The drawing frame also has a control unit 38 which is connected via a line 39 to the computer 28. A measuring member 40 which is connected via a line 41 to the computer 28 is connected downstream of the drawing frame 33. Known cans 42 which deliver the strips 35 are connected upstream of the drawing frame 33 and a can 43 which receives the drawn strip 44 is connected downstream of the drawing frame 33.

A similar construction can also be seen in the card machine 45 also shown very schematically here, since it also comprises a control 46 which is connected via a line 47 to the computer 28. A measuring member 48 for card strip 50 which is connected via a line 49 to the computer 28, is also provided at the outlet of the card machine 45.

It is preferably provided that a device of the type described above is only provided on the card machine, comber or on the drawing frame, even though here, for the sake of simplicity, the drawing combines the card machine and the drawing frame with the computer 28.

The mode of operation of the invention is as follows:

The strip 37, 44 at the outlet of the drawing frame 33 or the strip 50 at the outlet of the card machine 45 or a comber, is continuously measured in the measuring member 40 or 48 and converted into an electrical or equivalent signal 5. The measured values which form the signal 5 and, for example, scan the strip 1 in small stages, are compared in the computer 28 with a plurality of limiting values, as shown by the lines 15 to 22 in FIG. 3, or as they correspond to a classification field according to FIG. 4. In the process, it is detected which limiting values are exceeded by the signal or how many successive limiting values are exceeded. The result of this comparison or count is associated with a class according to FIG. 4. As these processes repeat themselves at intervals and take place in each scanning interval, the results assigned to the classes are also counted in a counter for each class. The classification system comprises, for example, 16 thick point classes in the classification field 24 and 16 thin point classes in the classification field 25. The results or occurrences which are assigned to these classes may be different depending on what they are based on. Therefore, it is possible to simply record the number of detected occurrences or variations in a class and to count them in this way. The variations detected can, however, also be counted and recorded per kilometre of yarn or per hour of production. Detection per kilometre takes place in this case, for example, under the assumption that the yarn produced from the strip has, for example, a draw with a factor 100. Therefore, variations counted per kilometre of strip length correspond to the number of variations to be expected for 100 kilometres of yarn length. The load of a spinning machine operator may also be ascertained from observations of this type if it is assumed that flaws of this type lead to a spinning point being turned off.

Displaying of flaws or variations by the classification according to FIG. 3 or 4 also allows disruptive and non-disruptive flaws to be differentiated and a boundary to be indicated therebetween in the classification field. Each user can himself decide according to his own criteria between which classes in FIG. 4 a boundary of this type should extend. Boundaries of this type can be safeguarded statistically as a function of the number of variations and also from discontinuous uncorrelated curves. Warnings during inputting of unsuitable limits can be derived therefrom and output by the computer 28. Therefore, quality features are derived from thick and thin points.

Thick and thin points are not to be immediately classified as being disadvantageous in every case and therefore the same degree of expenditure to eliminate them is also not justified in every case. Thin points which occur at the outlet of a drawing frame are definitely very critical as they are not eliminated in subsequent processing stages by doubling. In a ring spinner, thin points produce a relatively high twist in the yarn. As thin points offer less resistance to twisting such points are twisted more strongly and this in turn means that such points may subsequently only be drawn poorly. In addition to such points, however, weak points also occur in the yarn which stem from the fact that the more strongly twisted portions allow a lower degree of twisting in their vicinity. Other classes for undesired flaws are also produced depending on the site of the measurement of the strip.

In addition, a thin point is lengthened in the subsequent processing stages which is not always the case with a thick point. A thin point 2 cm in length in the strip downstream of the drawing frame is lengthened by approximately 5 m in a middle ring-spun or open-end yarn. In a simple woven fabric, this produces, for example, 2 mm wide disruptive weft bars. Causes for thin and thick points may be associated with specific classes and specific counter measures derived therefrom.

There are several general reasons for the occurrence of thin points in the strip.

Flaws often occur when a broken feed strip is placed manually on a drawing frame. Either the broken ends are joined so awkwardly that a thick point is produced or the strip ends are joined so loosely that a gap is produced. A thin point later results therefrom.

Thin points also occur as compensation in the vicinity of deflection points in the path of the strip owing to material being pushed thereon.

Setting errors, operating errors or deficient control electronics also lead to thin points.

Bonds and the tendency to form laps, for example as a consequence of honeydew, can lead to sporadic loosening of shreds from the woven fabric, and this, of course, also promotes thin points.

There are also reasons for thin points which are to be found in the machine. Therefore, card machines in particular promote the formation of holes in the woven fabric in the event of defective fittings, thin points in the event of defective band take-off, aperiodic faulty draws or owing to damaged woven guide elements. Combers can produce thin points in the strip during lap change or owing to poor strip batches. Drawing frames are particularly critical in the event of insufficient control, damaged funnel wheel depositing or poorly executed strip joins. Measures for controlling the consequences of the flaw may be derived in a targeted manner from the classifications of the flaws in view of such known causes for thin and thick points.

What is claimed is:

1. Process for monitoring the quality of a strip made of textile fibers which is moved in its longitudinal direction, comprising:

continuously detecting variations in the mass of the strip;

converting the detected variations into an electrical signal;

comparing the electrical signal with a plurality of predetermined limiting values, wherein the predetermined limiting values include a first set of limiting values being provided for variations transverse to the longitudinal direction and a second set of limiting values being provided for deviations in the longitudinal direction of the strip.

2. Process according to claim 1, further comprising:

determining values for a length and values for a cross-sectional variation for each variation from the comparison of the signal with the predetermined limiting values; and associating the determined values for the length and the cross-sectional variation with one or more of the plurality of predetermined limiting values to thereby define a quality feature, identical quality features being counted.

3. Process according to claim 1, further comprising forming classes for quality features based on the limiting values.

4. Process according to claim 1, wherein the limiting values for the variation in the longitudinal direction follow each other at intervals of 1 cm and the limiting values for the variation transverse to the longitudinal direction follow each other at intervals of 5% of a mean mass of the strip.

5. Process according to claim 1, wherein detecting variations in the mass of the strip includes detecting a variation exceeding a mean mass of the strip and a variation falling below a mean mass of the strip.

6. Process according to claim 2, further comprising deriving a measure for improving the quality of the strip from the quality features.

7. Process according to claim 1, wherein detecting variations in the mass of the strip comprises:

detecting thin places in the strip; and classifying thin places in the strip as variations.

8. Device for carrying out the process according to claim 1, comprising a measuring member for continuous detection of the mass of the strip, wherein the measuring member is provided at the outlet of a machine for spinning preparation and is connected to a computer which comprises an input unit for inputting a plurality of limiting values and an output unit for data.

9. Device according to claim 8, wherein the computer is connected to a control unit of the machine for spinning preparation.

* * * * *